US008186683B2

(12) United States Patent
Wilheit, Jr.

(10) Patent No.: US 8,186,683 B2
(45) Date of Patent: May 29, 2012

(54) METHOD AND APPARATUS FOR PROVIDING TARGET GAME MATS UTILIZED WITH A GAME

(75) Inventor: Philip Arthur Wilheit, Jr., Atlanta, GA (US)

(73) Assignee: TargetMatZ LLC, Atlanta, GA (US)

( * ) Notice: Subject to any disclaimer, the term of this patent is extended or adjusted under 35 U.S.C. 154(b) by 252 days.

(21) Appl. No.: 12/708,200

(22) Filed: Feb. 18, 2010

(65) Prior Publication Data

US 2011/0198811 A1 Aug. 18, 2011

(51) Int. Cl.
*A63B 71/00* (2006.01)

(52) U.S. Cl. ..... 273/317; 273/348

(58) Field of Classification Search ..... 273/317, 273/348; 473/588; D21/303
See application file for complete search history.

(56) References Cited

U.S. PATENT DOCUMENTS

| | | | | | |
|---|---|---|---|---|---|
| 922,717 | A * | 5/1909 | Parker | 273/401 |
| 2,634,982 | A * | 4/1953 | Gaede | 473/588 |
| 2,998,251 | A * | 8/1961 | McShane | 473/588 |
| 3,876,070 | A * | 4/1975 | Nagy | 206/315.1 |
| 4,486,023 | A * | 12/1984 | Tomoff | 273/348 |
| 4,563,008 | A * | 1/1986 | Fielden | 273/126 R |
| 5,316,310 | A * | 5/1994 | Nicholas et al. | 273/317 |
| D405,474 | S * | 2/1999 | Trondson | D21/303 |
| 6,464,226 | B1 * | 10/2002 | Kephart | 273/401 |
| 6,932,344 | B1 * | 8/2005 | Soto | 273/400 |
| D548,286 | S * | 8/2007 | Taylor et al. | D21/303 |
| 7,731,196 | B2 * | 6/2010 | Scoccia | 273/348 |
| D644,269 | S * | 8/2011 | Wilheit, Jr. | D21/303 |
| 2002/0079645 | A1 * | 6/2002 | Brown | 273/348 |
| 2007/0216102 | A1 * | 9/2007 | Matilla et al. | 273/317 |
| 2008/0277874 | A1 * | 11/2008 | Scoccia | 273/348 |
| 2009/0058007 | A1 * | 3/2009 | Neverdahl | 273/348 |
| 2010/0001470 | A1 * | 1/2010 | Corrington | 273/348 |
| 2011/0198811 | A1 * | 8/2011 | Wilheit, Jr. | 273/348 |

* cited by examiner

*Primary Examiner* — Raleigh W. Chiu
(74) *Attorney, Agent, or Firm* — Alston & Bird LLP

(57) ABSTRACT

A kit of components for playing a game and a method of using the components of the kit is provided. The kit may include a plurality of game mats. Each of the game mats may include a plurality of sections and each of the sections may be assigned a different point value that is marked on respective sections of the game mats. The different point values of each of the sections may be marked on an upper surface of the game mats. The kit may also include a plurality of tossable objects that are tossable on one or more of the sections of the game mats to obtain points associated with the value of the sections. The kit may also include a set of instructions or rules for playing the game and a case for carrying the game mats, the tossable objects and the instructions or rules.

9 Claims, 5 Drawing Sheets

8 (RED) – 7 (BLUE) = +1
RED TEAM SCORE +1
Step 440

8 (RED) – 7 (BLUE) = +1
RED TEAM SCORE +1
Step 440

METHOD AND APPARATUS FOR PROVIDING TARGET GAME MATS UTILIZED WITH A GAME

TECHNOLOGICAL FIELD

Embodiments of the invention relate generally to a target game mat(s) and more particularly relate to a method and apparatus for providing a target game mat(s) in which tossable objects may be tossed on the target game mat(s) by one or more individuals to provide an enjoyable and entertaining game.

BACKGROUND

Games have been played in many cultures and societies throughout the world to provide amusement and satisfaction to individuals. Currently, games are being developed with improvements as well as new challenges to keep individuals interested and may help individuals release tension. Due to the therapeutic, recreational as well as educational benefits of many games, people of all ages and education levels are utilizing games for personal enjoyment and entertainment.

However, many of today's games suffer from drawbacks. In this regard, games such as, for example, cornhole, which typically utilize bean bags that are tossed into holes at a raised platform by one or more players are typically bulky and may not be easily portable. For instance, the platforms associated with cornhole games are typically made with plywood or plastic and may measure between 3 to 4 feet. Due to the size and bulkiness of the wooden or plastic platforms, the platforms associated with the cornhole games may not be easily portable which may make it more difficult to transport the game to play in locations that may be desirable by individuals. Additionally, because the platforms are made of plywood or plastic and the bean bags are typically cotton bags filled with feed corn or the like, the costs associated with many cornhole games may be more than some consumers are willing to pay, which may decrease interest in the game among some individuals.

In view of the foregoing drawbacks, it may be advantageous to provide a game that is easily portable, durable and fun as well as economical while at the same time being interesting and challenging to individuals.

BRIEF SUMMARY

Embodiments of the invention are therefore provided that enable provision of a game that is fun and entertaining while also being easy to transport, durable and affordable. With the game of the exemplary embodiments there are no bulky wooden platforms to carry around which are used in some conventional games such as, for example, cornhole. Additionally, there are no clumsy pipe systems to assemble as in some conventional games. Instead, the exemplary embodiments may provide a game that takes up less than one-fifth (⅕th) the space of conventional games such as, for example, cornhole and may cost a fraction of the price. Moreover, since the game mats of the exemplary embodiments may be flexible and foldable (or may be rolled up), the game of the exemplary embodiments may be easy to transport.

In an exemplary embodiment, a game for enjoyment and amusement of one or more individuals is provided. The game may include at least one game mat having a plurality of sections each of which is assigned a point value that is marked on the respective section of the game mat. The game may also include a plurality of objects that are tossable on one or more of the sections of the game mat to obtain points associated with the value of the respective one or more of the sections. The point values of the sections may be marked on an upper surface of the game mat.

In yet another exemplary embodiment, a method for playing a game for enjoyment and amusement of one or more individuals is provided. The method may include providing a pair of game mats having a plurality of sections each of which is assigned a value that is marked on the respective sections of the game mats. The method may further include providing at least first and second sets of tossable objects that are tossable on one or more of the sections of the game mats to obtain points associated with the value of the respective one or more of the sections of the game mats and providing at least first and second teams. The first and second teams may each include two individuals. The first and second individuals of the first and second teams may be situated proximate to a first game mat of the pair of game mats. Additionally, the third and fourth individuals of the first and second teams may be situated proximate to a second game mat of the pair of game mats. The point values of the sections may be marked on an upper surface of the game mats.

In yet another exemplary embodiment, a kit of component parts for playing a game is provided. The kit may include a plurality of game mats. Each of the game mats may comprise a plurality of sections and each of the sections may be assigned a different point value that is marked on respective sections of the game mats. The different point values of each of the sections may be marked on an upper surface of the game mats. The kit may also include a plurality of tossable objects that are tossable on one or more of the sections of the game mats to obtain points associated with the value of the sections and a set of instructions or rules for playing the game. The kit may also include a case for carrying the game mats, the tossable objects and the instructions/rules.

In this regard, embodiments of the invention may provide a game that is fun, challenging and entertaining but yet allows ease in portability and reduced costs to individuals.

BRIEF DESCRIPTION OF THE SEVERAL VIEWS OF THE DRAWINGS

Figure 1:
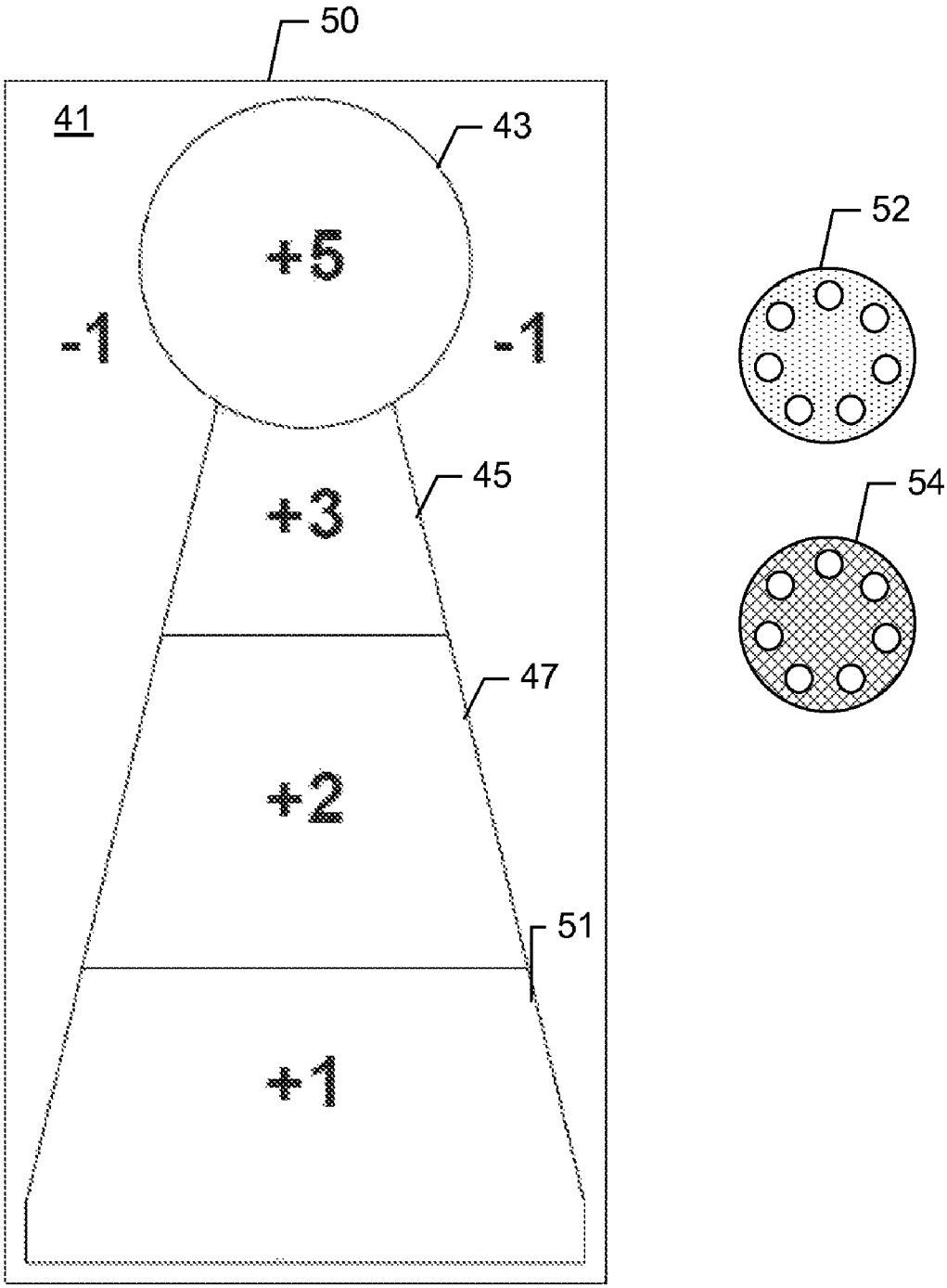
Figure 2:
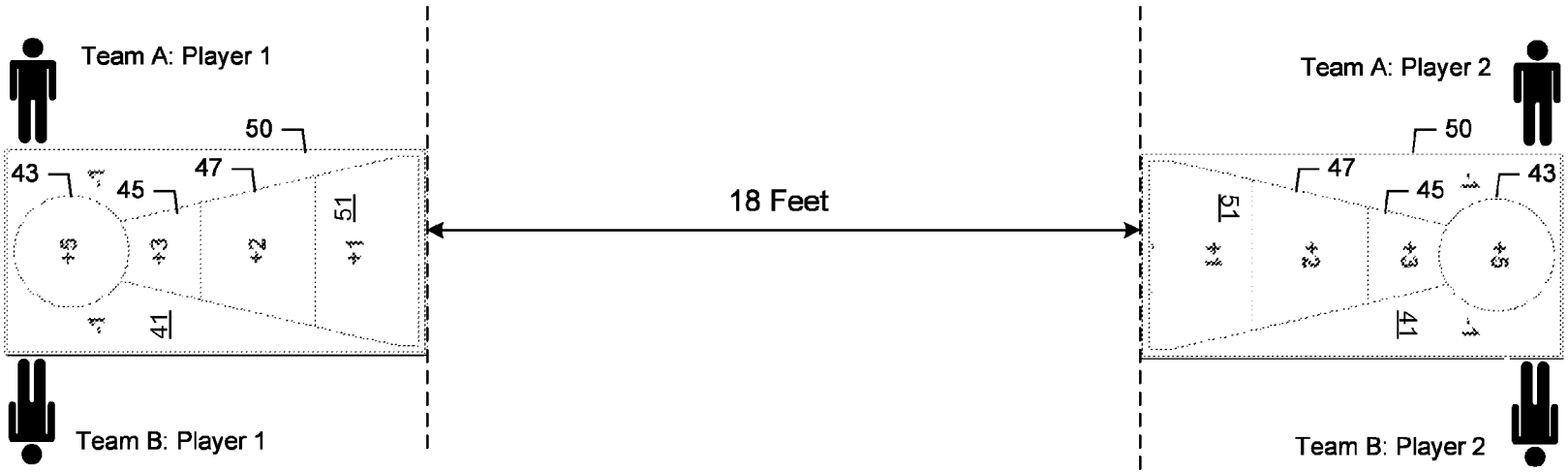
Figure 3A:
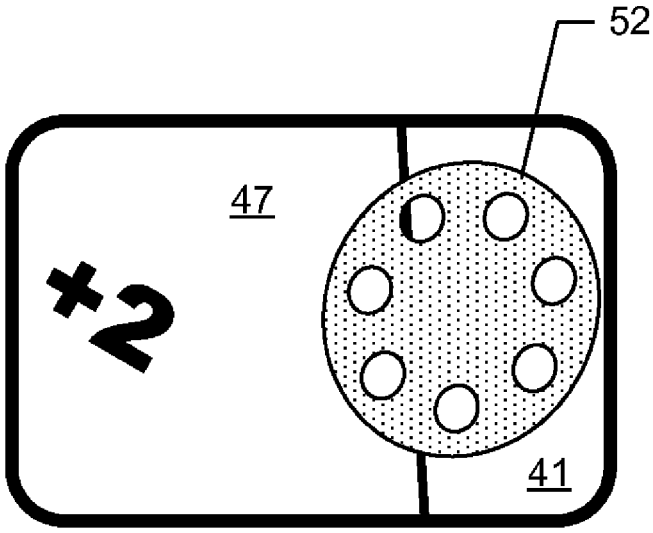
Figure 3B:
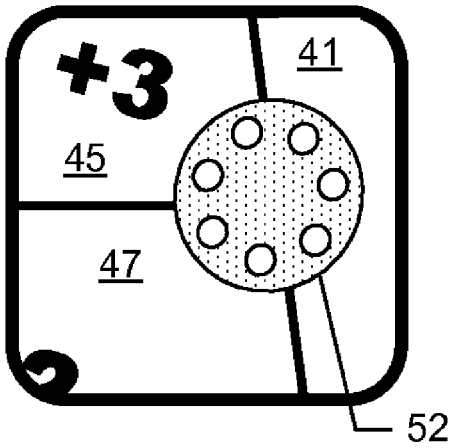
Figure 3C:
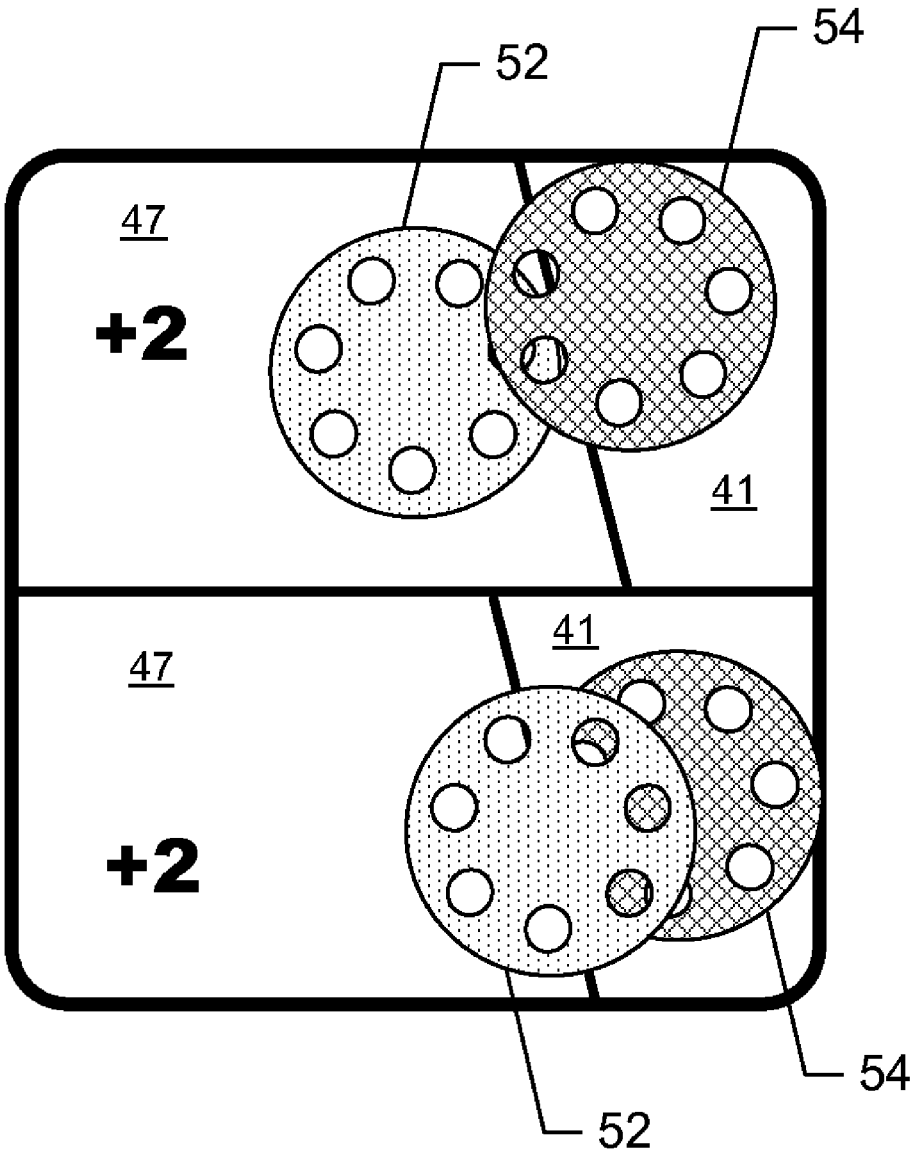
Figure 4:
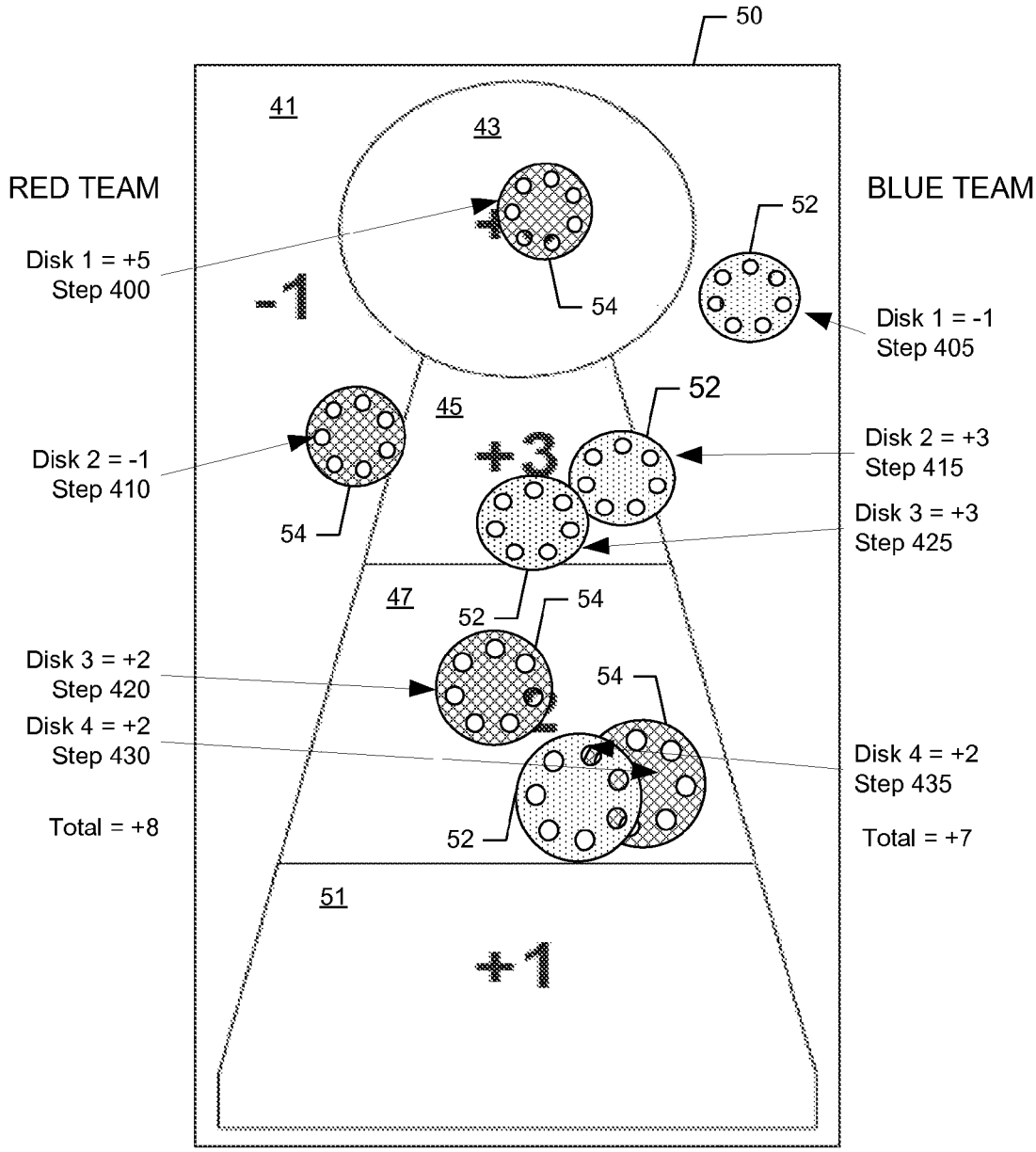

Having thus described the invention in general terms, reference will now be made to the accompanying drawings, which are not necessarily drawn to scale, and wherein:

FIG. 1 is a diagram of a target game mat and discs according to an exemplary embodiment of the invention;

FIG. 2 is a diagram of a configuration of a game according to an exemplary embodiment of the invention;

FIGS. 3A, 3B & 3C are diagrams of portions of a target game mat with one or more discs according to exemplary embodiments of the invention; and FIG. 4 is diagram illustrating a method of an example round of a game according to an exemplary embodiment of the invention.

DETAILED DESCRIPTION

Some embodiments of the present invention will now be described more fully hereinafter with reference to the accompanying drawings, in which some, but not all embodiments of the invention are shown. Indeed, various embodiments of the invention may be embodied in many different forms and should not be construed as limited to the embodiments set forth herein. Like reference numerals refer to like elements throughout. As used herein, the term "exemplary," is not provided to convey any qualitative assessment, but instead merely to convey an illustration of an example. Thus, use of any such terms should not be taken to limit the spirit and scope of embodiments of the invention.

FIG. 1 illustrates a diagram of a game mat 50 and discs 52 and 54 for playing a game according to an exemplary embodiment of the invention. For purposes of illustration and not of limitation it should be pointed out that the embodiments of the game may include more than one game mat 50 and more than two discs 52 and 54. For example, in an exemplary embodiment, the game (or game set) may include, but is not limited to, two game mats 50 and eight discs (e.g., four discs 52 and four discs 54). Although not shown, the game (or game set) may also include game rules or instructions, and a carrying case that may be used to carry the game mat(s) 50, the discs (e.g., discs 52 and 54) and the game rules or instructions. It should also be pointed out that the different cross-hatchings of disc 52 and disc 54 may denote different colors of the discs. In an exemplary embodiment, one team playing the game may use discs 54 and another team playing the game may use discs 52, as described more fully below.

The discs 52 and 54 may be lightweight, aerodynamic and may include holes (e.g., 7 holes) which may enhance the flight (e.g., movement of the discs through the air) of the discs 52 and 54 as they are thrown onto the game mat 50 by individuals, for example. In other words, the holes in the discs 52 and 52 may improve flight accuracy and may also reduce the weight of the discs 52 and 54. The holes of the discs 52 and 54 may also be used in part to determine a score for the game of the exemplary embodiments, as described more fully below. It should be pointed out that the game mat 50 and the discs 52 and 54 may be made out of the same material. In an exemplary embodiment, the game mat 50 and the discs 52 and 54 may be made out of a material such as, for example, vinyl or molded vinyl. The discs 52 and 54 may be economical in part based on the size and material of the discs. The holes of the discs may also help to reduce the costs of the discs.

As shown in FIG. 1, the game mat 50 may include sections (also referred to herein as areas) 41, 43, 45, 47 and 51. Each of the sections of the game mat 50 is associated with a different value, which may be marked or labeled on an upper surface of the game mat 50. For instance, section 41 may be associated with a value of −1, section 43 may be associated a value of +5 (or more simply 5), section 45 may be associated with a value of +3 (or more simply 3), section 47 may be associated with a value of +2 (or more simply 2) and section 51 may be associated with a value of +1 (or more simply 1). Although not shown, each of the sections 41, 43, 45, 47 and 51 may additionally or alternatively be associated with a respective color.

In an exemplary embodiment, each of the colors of the sections 41, 43, 45, 47 and 51 may be different. For example, section 41 may have a color such as blue, section 43 may have a color such as yellow, section 45 may have a color such as orange, section 47 may have a color such as green and section 51 may have a color such as red. It should also be pointed out that sections 41, 43, 45, 47 and 51 may have any other suitable colors without departing from the spirit and scope of the invention.

When three or more holes of the discs 52 and 54 are on or in a section (e.g., section 43), a team may be given a score associated with the value (e.g., 5) corresponding to the section, as described more fully below. It should be pointed out that the game mat 50 may be flexible and easily foldable. In an exemplary embodiment, the game mat 50 may be made of one or more layers of vinyl or molded vinyl that is approximately ⅜ of an inch thick. In this regard, the game mat 50 may be rolled or folded up and easily portable so that individuals may transport the game with ease. By using vinyl or molded vinyl to make the game mat 50, the game mat 50 of the exemplary embodiments may be economical.

Referring now to FIG. 2, a diagram illustrating a configuration of the game according to an exemplary embodiment is provided. As shown in FIG. 2, the game may include multiple teams (e.g., two teams, for e.g., Team A and Team B) consisting of multiple players (e.g., two players per team). Each team may be provided with a number of discs to utilize for playing the game. In an exemplary embodiment, four discs may be provided to each team. As such, the teams may throw a total of eight discs onto game mats 50. It should also be pointed out that the color of the discs 52 and 54 utilized by each team may be different. For example, the discs 54 may be utilized by one team (e.g., Team A) and the discs 54 may be the same color (e.g., red), whereas each of the discs 52 may be utilized by another team (e.g., Team B) and the discs 52 may be another color (e.g., blue).

The discs 52 and 54 may be thrown (e.g., alternately thrown) by the players of each team from a predefined distance to one of the game mats 50. In an exemplary embodiment, the players of each team may throw the discs 52 and 54 onto a game mat 50 that is at least 18 feet away from another game mat. It should be pointed out however that the players of the teams may throw the discs 52 and 54 to a game mat 50 that is any other suitable distance (e.g., 20 feet) away from another game mat 50. In this regard, players should not cross the front of a respective game mat 50 (e.g., the dotted lines associated with the game mats 50 in FIG. 2) when throwing the discs 52 and 54 onto a game mat 50.

In the exemplary embodiment of FIG. 2, the teams may alternate throwing discs 52 and 54 from a predefined distance (e.g., 18 feet). For example, player 1 of Team A may throw a disc 54 onto a game mat 50 that is a predefined distance away and then player 1 of Team B may throw a disc 52 onto a game mat 50 that is a predefined distance away. After player 1 of Team B throws a disc 52 onto a game mat 50 a predefined distance away, player 1 of Team A may throw a disc 54 onto a game mat 50 that is a predefined distance (e.g., 18 feet) away. Subsequently, player 1 of Team B may throw another disc 52 onto a game mat 50 that is a predefined distance away.

This process may be repeated until a team has thrown all four of their discs (e.g., discs 52 and/or discs 54), which may complete a round. For instance, after player 1 of Team B throws a disc 52 onto a game mat 50 a predefined distance away, player 1 of Team A may throw another disc 54 onto a game mat 50 that is a predefined distance away and thereafter player 1 of Team B may throw another disc 52 onto a game mat 50 that is a predefined distance (e.g., 18 feet) away. Subsequently, player 1 of Team A may throw another disc 54 onto a game mat 50 that is a predefined distance away and then player 1 of Team B may throw another disc 52 onto a game mat 50 that is a predefined distance away. In this regard, each team may throw all of their four discs (e.g., four discs 52 and four discs 54, which total eight discs) and a round of the game may be completed.

It should be pointed out that points may be calculated at the end of a round and the next round may begin with player 2 of Team A and player 2 of Team B alternately throwing each of their four discs on a game mat 50 a predefined or predetermined distance away in a manner analogous to that described above with respect to player 1 of Team A and player 1 of Team B. In an exemplary embodiment, the team (e.g., Team B) that scores the highest in a previous round may be the team that begins throwing a disc (e.g., disc 52 or disc 54) in the next round (e.g., player 2 of Team B may begin throwing a disc 52 in a second round).

Referring now to FIGS. 3A, 3B and 3C, diagrams illustrating mechanisms in which scoring is determined for the game according to exemplary embodiments are provided. Referring now to FIG. 3A, a portion of a game mat 50 including a disc 52 thereon is provided. In an exemplary embodiment, the first team to score 25 points for all of the rounds may win the game. While a score of 25 points for all of the rounds of the game may be used as a score to win the game, it should be pointed out that any other suitable score (e.g., 30 points) may be used or designated in order to win the game.

In the exemplary embodiments, points may be earned by throwing the discs 52 and 54 on different sections (e.g., sections 41, 43, 45, 47 and 51) of the game mats. For instance, points may be earned according to where the discs 52 and 54 end up or land on the game mat(s) 50 when thrown by a player. According to an exemplary embodiment, three holes of the discs 52 and 54 may be required to be in a section (e.g., section 43) of a game mat 50 in order to be considered in scoring range and to obtain points associated with a value (e.g., +5) of a corresponding section (e.g., section 43). However, in an alternative exemplary embodiment, any other number of holes (e.g., four holes) may be required to be on or in a section in order to be considered in scoring range. In an exemplary embodiment, only holes that are substantially completely on or in a section(s) or holes showing a full color that corresponds to a color of a section(s) of the game mat 50 may count as being considered in scoring range. As an example consider FIG. 3A, in which two of the holes of disc 52 are in section 47 and three or more holes are in section 41 of the game mat 50. As such, a player may obtain a score of −1 in this example corresponding to the value of section 41.

Moreover, if four holes of a disc 52 are in section 41 and three full holes are off or not on the game mat 50, a player may take a score of zero (e.g., "0") instead of a score of minus 1 (e.g., −1) corresponding to the value of section 41. In this regard, areas off of the game mat 50 may be assigned a value of zero when three or more holes of the disc(s) are off the game mat 50 and other holes of the disc(s) are on the game mat 50. It should also be pointed out that the game may, but need not, utilize a net scoring system. For example, if a first team (e.g., Team A) scores a total of 6 points and a second team (e.g., Team B) scores 4 points in a round, the first team (e.g., Team A) may obtain 2 points (e.g., 6−4=2) for the round while the second team (e.g., Team B) does not obtain any points (e.g., zero points). The first team may obtain the 2 points in this example since the first team scored higher (e.g., 6 points) than the second team (e.g., 4 points). It should be pointed out that in an exemplary embodiment gameplay may continue until a team reaches a predetermined score (e.g., 25 points) by totaling the net scores after each round in the manner described above.

When a disc (e.g., disc 52 or disc 54) lands on a game mat with three to four full holes split between two scoring values with the remainder of the holes of the disc (e.g., disc 52 or disc 54) in a negative or non-scoring value (e.g., a value of 0 corresponding to an area off the game mat), a player may obtain a score associated with the lower positive point value. As an example consider FIG. 3B in which a disc 52 has two full holes in section 45 corresponding to a value of 3, two full holes in section 47 corresponding to a value of 2 and three full holes in section 41 corresponding to a value of −1. As such, in this example, a player may obtain a score of 2 points since section 47 has the lower positive value (e.g., +2) with respect to section 45 which is associated with a higher positive value of +3. It should be pointed out that the score of 2 points may be awarded in this example, even though the majority of holes (e.g., three in this example) of the disc 52 are in section 41 corresponding to a value of −1 since the disc 52 is split between two positive scoring values with the remainder in a negative scoring value.

It should also be pointed out that a score may be obtained when a disc lands on top of another disc according to exemplary embodiments of the game. In this regard, consider the upper portion of FIG. 3C in which a portion of disc 54 having five holes in section 41 is on top of a portion of disc 52 having all of its holes in section 47. In this regard, the disc 52 may earn or obtain a score of 2 since section 47 is associated with a value of +2. On the other hand, the disc 54 may earn or obtain a score of −1 since section 41 is associated with a score of −1 and given that three full holes of the disc 54 are in section 41. The disc 54 does not earn a score of 2 in this example because disc 54 does not have three full holes in section 47.

Referring now to the lower portion of FIG. 3C, a portion of disc 52 is on top of a portion of disc 54. Since disc 52 has three full holes in section 47, disc 52 may earn a score of 2 given that section 47 is associated with a value of +2. On the other hand, disc 54 may earn a score of −1 since disc 54 has more than three full holes in section 41 which is associated with a value of −1 and given that disc 54 does not have three full holes in section 47.

Referring now to FIG. 4, a method of an example round of the game according to an exemplary embodiment is provided. In the exemplary embodiment of FIG. 4 there are two teams, such as for example a red team and a blue team, playing the game and each team may include two players. In this exemplary embodiment, the two teams may throw discs 52 and 54 on a single game mat 50 during a round. Additionally, each team may have four discs. In the exemplary embodiment of FIG. 4, the red team may have four discs 54 and the blue team may have four discs 52. Also, in the example of FIG. 4, player 1 of the red team and player 1 of the blue team may alternately throw all of the discs 52 and 54 on one or more sections of the game mat 50 in a round (e.g., a first round), and during a subsequent round (e.g., second round) player 2 of the red team and player 2 of the blue team may alternately throw all of the discs 52 and 54 on one or more sections of a game mat 50. It should also be pointed out that in FIG. 4, player 1 of the red team may start the round and throw a disc 54 from a predefined or predetermined distance (e.g., 18 feet) from a game mat 50 onto the game mat 50 of FIG. 4.

In this example, player 1 of the red team threw the disc 54 on section 43 of the game mat 50 of FIG. 4. Since disc 54 has 3 or more full holes in section 43, the red team may obtain a score of +5 points. (See step 400) Next, player 1 of the blue team may throw a disc 52 from a predefined or predetermined distance of a game mat onto section 41 of the game mat 50 of FIG. 4. As such, the blue team may obtain a score of −1 since 3 or more full holes of the disc 52 are in section 41. (See step 405) Thereafter, player 1 of the red team may throw a disc 54 onto section 41 of the game mat 50 of FIG. 4. In this regard, the red team may obtain a score of −1 since three or more full holes of the disc 54 are in section 41. (See step 410)

Subsequently, player 1 of the blue team may throw a disc 52 onto sections 41 and 45 of the game mat 50 of FIG. 4. Since three or more full holes of the disc 52 are in section 45 and three or more full holes of the disc 52 are not in section 41, the blue team may obtain a score of +3. (See step 415) Next, player 1 of the red team may throw a disc 54 onto section 47 of the game mat 50 of FIG. 4. Since the disc 54 has three or more full holes in section 47, the red team may obtain a score of +2. (See step 420) Subsequently, player 1 of the blue team may throw a disc 52 onto section 45 of the game mat 50 of FIG. 4. The disc 52 has three or more full holes in section 45 of the game mat 50 and as such the blue team may obtain a score of +3. (See step 425)

Next, player 1 of the red team may throw disc 54 onto section 47 of the game mat 50 of FIG. 4. The disc 54 has three or more full holes in section 47 and as such the red team may obtain a score of +2. (See step 430) Thereafter, player 1 of the blue team may throw a disc 52 onto section 47 of the game mat 50 of FIG. 4. The disc 52 has three or more full holes in section 47 and as such the red team may obtain a score of +2. (See step 435) In the example of FIG. 4, net scoring may be utilized and as such the total score for the red team may be calculated (e.g., 5−1+2+2=8) and the total score for the blue team may be calculated (e.g., −1+3+3+2=7). The difference between the total score for the red team (e.g., +8) and the total score for the blue team (e.g., +7) may be the score for the round (8−7=+1) and since the red team had a higher score than the blue team, the red team may be awarded the score (e.g., +1) for the round. (See step 440). Since the awarded score (e.g., +1) for the round may not equal a predetermined score (e.g., 25 points) designated as a winning score, another round(s) may be played until the predetermined score is reached by a team.

In this regard, the next round may, but need not, start with player 2 of the red team and player 2 of the blue team alternately trying to throw all of the discs 52 and 54 onto the game mat 50 of FIG. 4 and since the red team won the round in FIG. 4, player 2 of the red team may throw the first disc of the next round. As described above, in an exemplary embodiment, the first team to score 25 points for the rounds of the game may win the game. However, in an alternative exemplary embodiment, any suitable score (e.g., 20 points) other than 25 points for all of the rounds of the game may be used to determine the winning team of the game.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. A game, comprising:

at least one flexible game mat, the game mat comprising (a) a sufficient thickness as to lie substantially flat on a surface, and (b) a plurality of sections each of which is assigned a point value that is marked on the respective sections on an upper surface of the game mat; and a plurality of objects that are tossable on one or more of the plurality of sections of the game mat to obtain points associated with the value of the respective one or more of the plurality of sections, wherein each of the objects comprises a plurality of holes that are used in part to obtain points.

2. The game of claim 1, wherein the tossable objects comprise circular discs.

3. The game of claim 2, wherein when at least a predetermined number of the holes are on or in at least one of the sections, a score associated with the value of the at least one section is obtained, and wherein the sections comprises corresponding areas of a different size.

4. The game of claim 3, wherein the predetermined number of holes comprises three holes.

5. The game of claim 2, wherein a number of the plurality of holes is seven.

6. The game of claim 2, wherein each of the sections of the game mat comprises a different color, and wherein when a color of at least one section is viewable via at least a predetermined number of the holes, a score associated with the value of the at least one section is obtained.

7. The game of claim 2, wherein:

the game mat comprises a pair of game mats; and the discs comprise a first set of discs and a second set of discs, wherein the first set of discs are tossable on sections of a first game mat of the pair, and the second set of discs are tossable on sections of a second game mat of the pair.

8. The game of claim 7, wherein the first set of discs and the second set of discs comprise different colors, and wherein the first set of discs are used by individuals of a first team and the second set of discs are used by individuals of a second team.

9. The game of claim 7, wherein the first and second game mats are situated at a predetermined distance relative to each other based on a distance between first portions of the first and second game mats, and in order for a value associated with the sections of the first and second game mats to count towards a score, the individuals of the first and second teams are not allowed to cross the first portions when tossing the discs onto the first and second game mats.

* * * * *